US012070090B2

(12) United States Patent
Martel

(10) Patent No.: US 12,070,090 B2
(45) Date of Patent: Aug. 27, 2024

(54) COMPACT RAIN-SUIT TO BE FITTED INSIDE A WAIST BELT AND METHOD OF USE

(71) Applicant: Yves Martel, Levis (CA)

(72) Inventor: Yves Martel, Levis (CA)

( * ) Notice: Subject to any disclaimer, the term of this patent is extended or adjusted under 35 U.S.C. 154(b) by 31 days.

(21) Appl. No.: 17/981,427

(22) Filed: Nov. 6, 2022

(65) Prior Publication Data

US 2023/0263252 A1 Aug. 24, 2023

(51) Int. Cl.
*A41F 9/00* (2006.01)
*A41D 15/04* (2006.01)

(52) U.S. Cl.
CPC ..... *A41F 9/00* (2013.01); *A41D 15/04* (2013.01); *A41D 2200/10* (2013.01); *A41D 2400/422* (2013.01)

(58) Field of Classification Search
CPC ..... A41D 15/04; A41D 15/002; A41D 15/00; A41D 2400/422; A41D 2400/424; A41D 31/32; A41D 3/06; A41D 2200/10; A41F 9/00
See application file for complete search history.

(56) References Cited

U.S. PATENT DOCUMENTS

| | | | |
|---|---|---|---|
| 3,389,407 | A | 6/1968 | Morrison |
| 3,670,340 | A | 6/1972 | Walker |
| 3,801,986 | A | 4/1974 | Purdon |
| 3,849,803 | A | 11/1974 | Connors |
| 4,404,687 | A | 9/1983 | Hager |
| 4,476,587 | A | 10/1984 | Itoï |
| 4,502,154 | A | 3/1985 | Itoïet al. |
| 5,452,476 | A | 9/1995 | Jenks |
| 5,564,125 | A | 10/1996 | Waldman et al. |
| 2008/0271222 | A1 | 11/2008 | Nienow |
| 2009/0205096 | A1 | 8/2009 | Seemann |
| 2013/0212772 | A1 | 8/2013 | Titus et al. |
| 2014/0373246 | A1 | 12/2014 | Chapuis |
| 2015/0150319 | A1 | 6/2015 | Wamsley |
| 2018/0255845 | A1 | 9/2018 | Elsenhuth et al. |
| 2019/0364985 | A1 | 12/2019 | Sachs et al. |

FOREIGN PATENT DOCUMENTS

| | | | | |
|---|---|---|---|---|
| DE | 10154129 C1 | * | 2/2003 | ..... A41D 15/04 |
| EP | 1308102 A2 | * | 5/2003 | ..... A41D 3/06 |
| FR | 2883457 A1 | * | 9/2006 | ..... A41D 15/00 |
| GB | 2388766 A | * | 11/2003 | ..... A41D 13/01 |

* cited by examiner

*Primary Examiner* — Alissa L Hoey

(57) ABSTRACT

A compact rain-suit to be fitted inside a waist belt and its method of use has a waist belt implement having three built-in pockets, two of which are for housing two chap style leg parts, and the third is for housing a poncho style torso covering part.

10 Claims, 6 Drawing Sheets

FIG. 6A
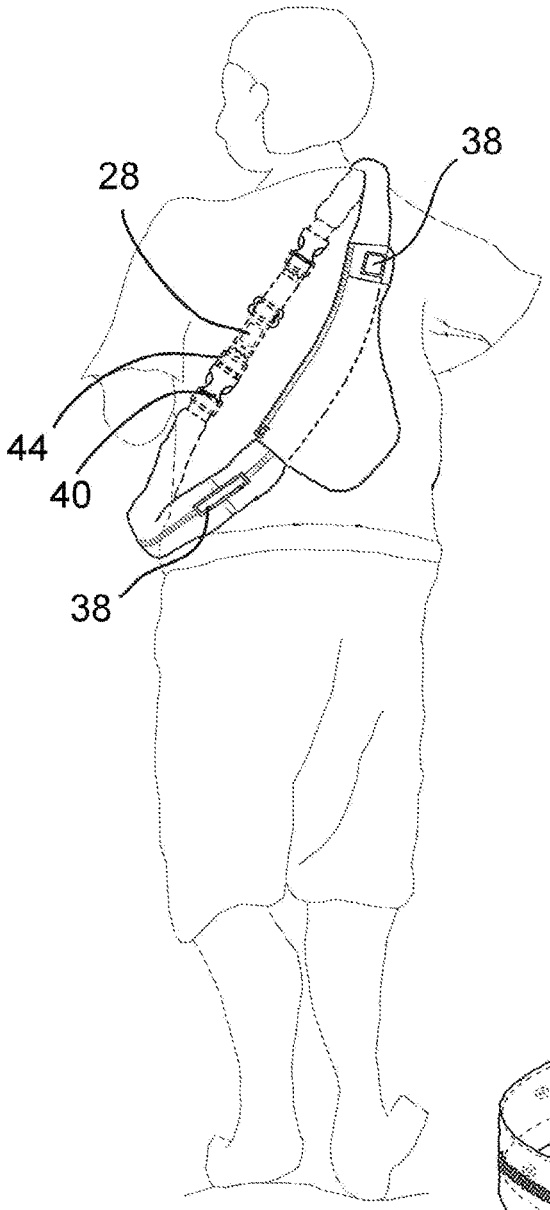
FIG. 6B
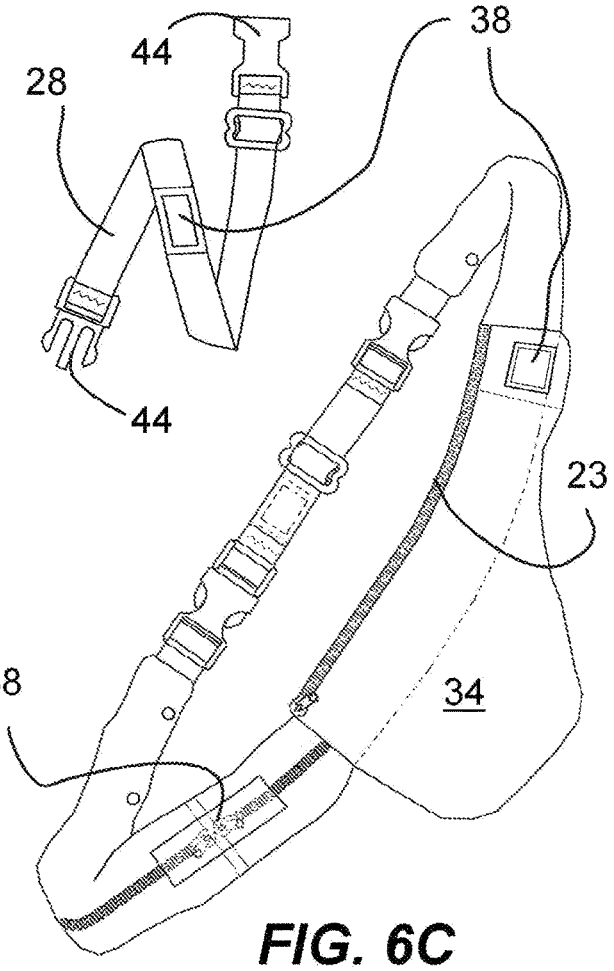
FIG. 6C
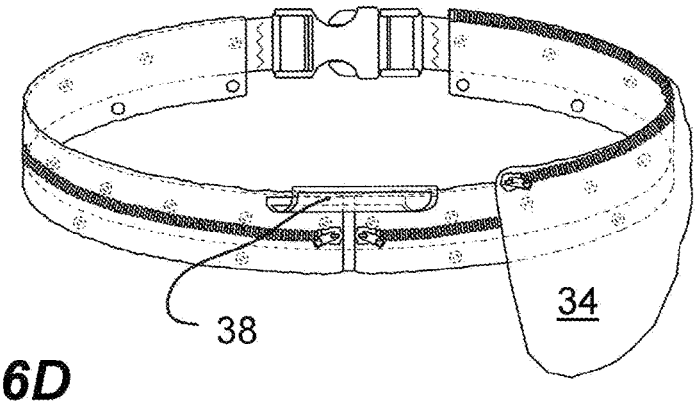
FIG. 6D

COMPACT RAIN-SUIT TO BE FITTED INSIDE A WAIST BELT AND METHOD OF USE

CROSS-REFERENCE TO RELATED APPLICATIONS

The present application claims priority to request for patent application number 2115976.9, filed on Nov. 7, 2021, the disclosure of which is hereby incorporated in its entirety at least by reference.

BACKGROUND OF THE INVENTION

1. Field of the Invention

The present invention relates generally to rain-suits, but more particularly to a compact rain-suit to be fitted inside a waist belt and its method of use

2. Description of Related Art

There are many types of rain suits available. Some are full suits, which means that they include waterproof pants, while some are raincoats that are long or short. Some types of rain suits are shaped like ponchos and made of a very thin plastic so as to be folded in a very compact fashion. Some types are in-between and include pants, which makes them ideal for cyclists, campers and are usually made of a thin, resilient and lightweight material which can be folded and put inside a pouch.

Example of such rain suits are found in the following prior art:

- U.S. Pat. No. 3,389,407 and European patent EP 1535527 describe a coat which notably includes a belt which contains separate drop-down trousers for the rain which are assembled by press studs.
- U.S. patent and patent applications 3670340, 20090205096 and 20130212772 describe a coat that can be deployed from a belt worn at the waist.
- U.S. Pat. No. 3,801,986 and French patent FR2883457 describe a backpack or a belt or a garment which notably contains trousers which open/close with a zipper.
- U.S. Pat. No. 3,849,803 describes a poncho that can unfold and fold up compactly.
- U.S. Pat. Nos. 4,404,687, 4,502,154, 5,564,125, and patent applications 20150150319 and 20180255845, as well as Canadian patent CA917351 describe a coat that can be deployed from a compact container or a belt. The container can in particular be worn at the waist by means of a strap, or otherwise on the shoulder as a shoulder strap. A zipper can hold the container.
- U.S. Pat. No. 4,476,587 and applications 20090205096 describe a coat that unfolds and folds into a compact container. The container has straps and zippers. The container may include an add-on section to hold miscellaneous small items.
- U.S. Pat. No. 5,040,243 describes a coat which notably has a belt which incorporates a second coat which unfolds. A zipper or hook and loop fasteners contain the second coat in the waistband
- U.S. Pat. No. 5,452,476 and French patent FR1434108 describe a belt which notably incorporates a poncho-style coat. The belt may have zippers.

- U.S. Pat. No. 7,966,672 describes trousers whose leggings can be separated laterally. The leggings can be rolled up and held at the waist.
- US patent application 20080271222 and French patent FR2181487 describe a belt which notably comprises two portions which cover the top and bottom of a person. The belt can be worn at the waist.
- US patent application 20100313324 describes a garment which notably discloses reflective strips.
- US patent application 20140373246, European patent EP2815665, and British patent GB2177284 describe a belt which comprises in particular an upper piece of clothing and lower leggings which can be assembled by means of a zipper. Parts of clothing may be waterproof.
- US patent 20190364985 describes a poncho that unfolds quickly from a belt that is worn at the waist.
- Austrian patent AT003613 describes a coat which is notably provided with leggings which unfold from pockets. The leggings are united by means of zippers.
- German patent DE10154129 describes a compact container which contains pieces of clothing which unfold. The container may include a strap that is worn around the waist or over the shoulder.

Despite numerous inventions in the field, there is still room for improvement when it comes to ease of use as well as the versatility of activities such a compactable rain suit can be used or combined with other functionalities.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a main object of the present disclosure to provide for a compact rain-suit to be fitted inside a waist belt and its method of use.

In order to do so, the present invention provides for a compact rain-suit designed to be fitted inside a waist belt implement having pockets comprising a poncho pocket and two pants pockets. The poncho pocket configured and sized to hold a rolled up poncho, and the leg pockets configured and sized to hold rolled up pant legs. The poncho pocket is located on the interior perimeter of the belt to which it is attached to at the upper edge and is accessed by unsnapping poncho pocket snaps located on the legs pockets which then allow the poncho pocket to be flipped or otherwise rolled upwardly so as to expose and access a poncho pocket zipper. Each leg of the pants is located in its own leg pocket and each leg pocket having its own pant zipper which are located on the outside periphery of the belt. The pockets co-existing within the thickness of the belt.

In a preferred embodiment, after unrolling the pants out of their pockets, their upper parts are snapped to snaps located inside the pants pockets.

In another preferred embodiment, each pant leg comes in two sections that are zippered together around each of the intended user's legs by way of pant zippers.

In yet another preferred embodiment, the poncho being releasably attached to the belt by way of a poncho flap being held to the belt by way of the combination of male female snap fasteners.

In still another preferred embodiment, the poncho has a "V" neck opening at the front of the with the "V" neck being closed by way of "V" neck buttons.

In yet another preferred embodiment the poncho is wrapped with the help of the flap which has a set of flap snaps so as to facilitate the rolling of the poncho into its pocket.

In still another preferred embodiment, a belt extension connecting to the belt using the snap buckle allows for the belt to be worn across the shoulder.

In another preferred embodiment, a tote bag style pouch having a pouch zipper and a rim zipper running proximal to the tote bag's own zipper to releasably attach the pouch to the belt. The tote hag rim zipper has one half on the belt and the other half on the tote hag and attaching the tote bag to the belt by connecting the two halves of the tote hag rim zipper.

In still another preferred embodiment, reflective bands located at various places on the belt, belt extension, and pouch for improved visibility and signaling in the dark.

The compact rain-suit has a method of use consisting in the steps of:

1) Unzipping the two leg compartments and take them out while unrolling them;
2) One legging at a time, join the two ends towards the inside of the upper thigh in order to zip the zipper from the top downwards;
3) Unbutton the snap fasteners at the bottom of the inside pocket of the belt in order to be able to lift it and have access to its zipper which faces the user;
4) Completely unzip the zipper to remove the wrapped poncho;
5) Once out, unroll the poncho towards the ground and put it on;
6) Unbutton the snap fasteners on the collar to pass the motorcycle helmet on, if necessary;
7) To re-insert one or other of the parts of the rain suit, simply reverse the steps described above.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which:

FIG. 6A Isometric view showing the invention in the over the shoulder configuration on an intended user FIG. 6B Isometric view of the belt.

FIG. 6C Isometric view showing the invention in the over the shoulder configuration.

FIG. 6D Isometric view of the invention in its belt around the waist configuration.

DETAILED DESCRIPTION OF THE PREFERRED EMBODIMENT

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein.

It is to be understood that the terminology used herein is for the purpose of describing particular embodiments only and is not intended to be limiting. The terms "a" or "an," as used herein, are defined as to mean "at least one". The term "plurality," as used herein, is defined as two or more. The term "another," as used herein, is defined as at least a second or more. The terms "including" and/or "having," as used herein, are defined as comprising (i.e., open language). The term "coupled," as used herein, is defined as connected, although not necessarily directly, not necessarily mechanically, and not permanent. The term "providing" is defined herein in its broadest sense, e.g., bringing/coming into physical existence, making available, and/or supplying to someone or something, in whole or in multiple parts at once or over a period of time. As used herein, the terms "about", "generally", or "approximately" apply to all numeric values, whether or not explicitly indicated. These terms generally refer to a range of numbers that one of skill in the art would consider near the stated amount by about 0%, 5%, or 10%, including increments therein. In many instances these terms may include numbers that are rounded to the nearest significant figure.

Figures 1A, 1B:
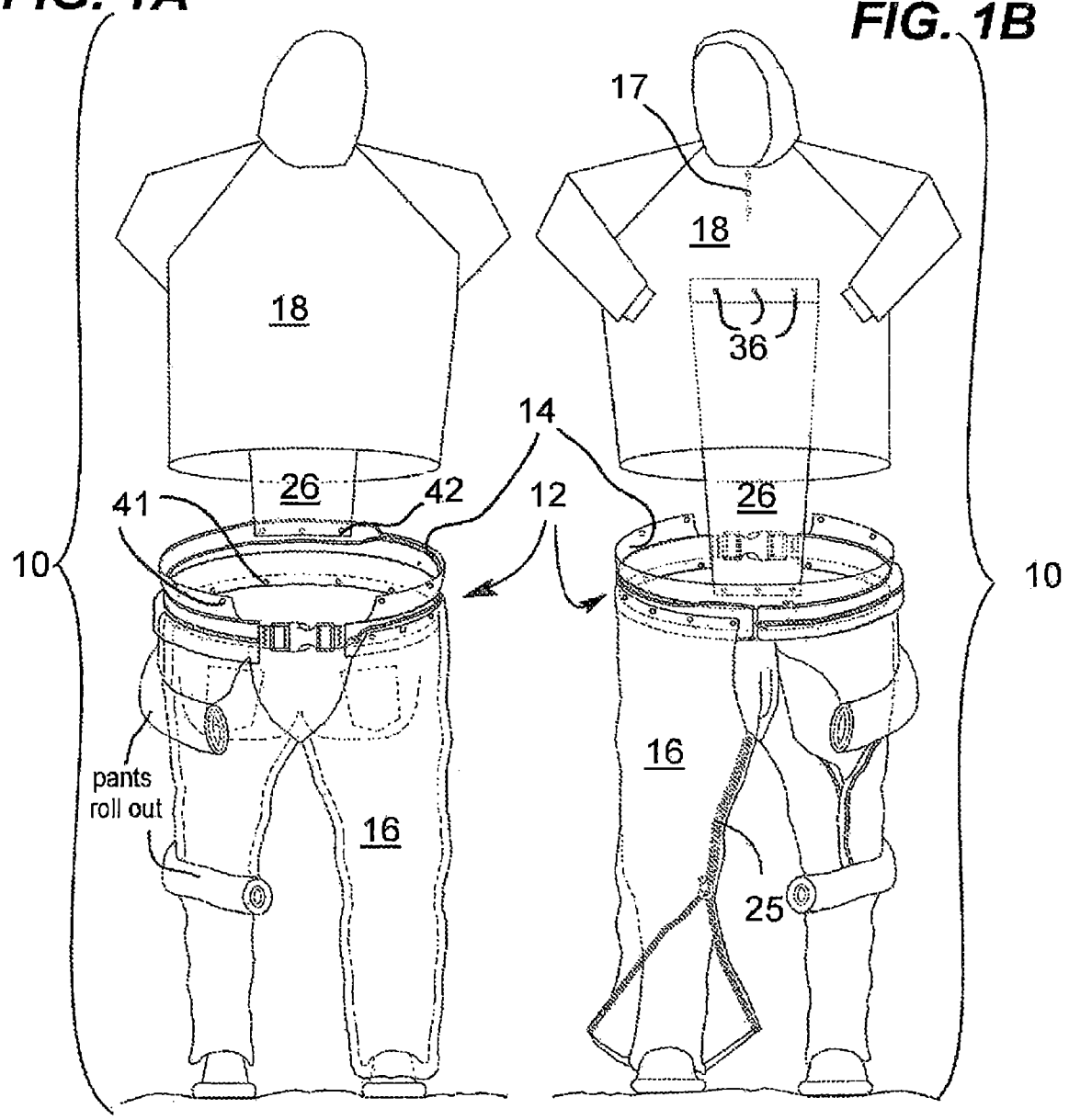
FIG. 1A Isometric exploded view of an embodiment of the invention as seen from the back.
FIG. 1B Isometric exploded view of an embodiment of the invention as seen from the front.
Figure 2:
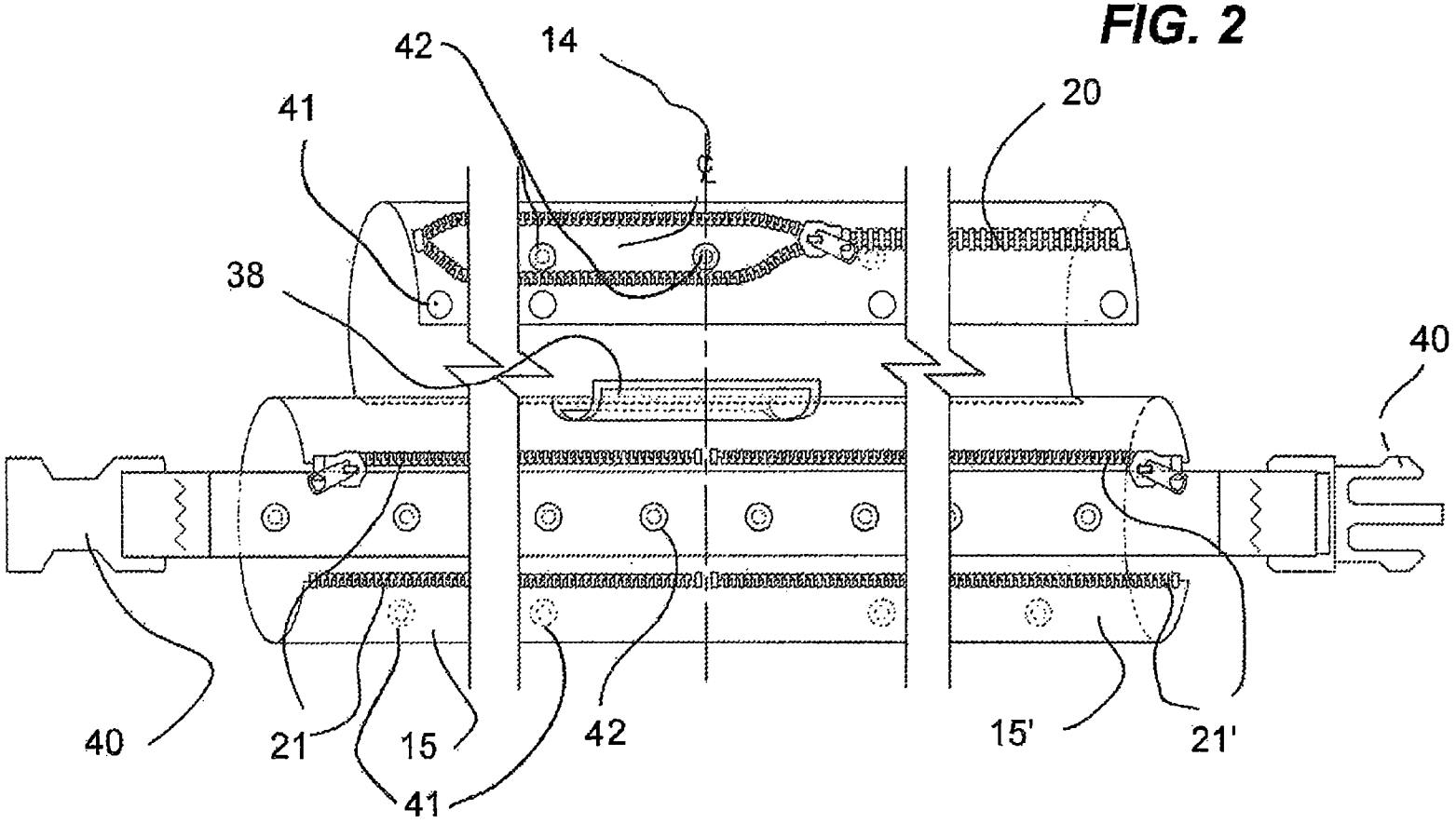
FIG. 2 Sectional views of the belt opened up and laid flat.
Figure 3A:
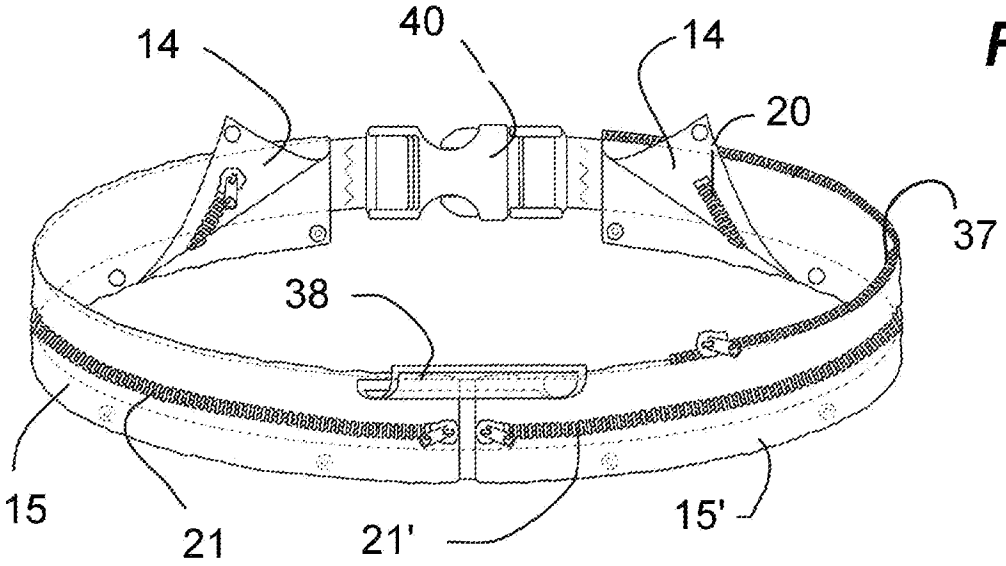
FIG. 3A Isometric view of the front of the belt showing the deployment and folding of the inner pocket that contains the Poncho.
Figure 3B:
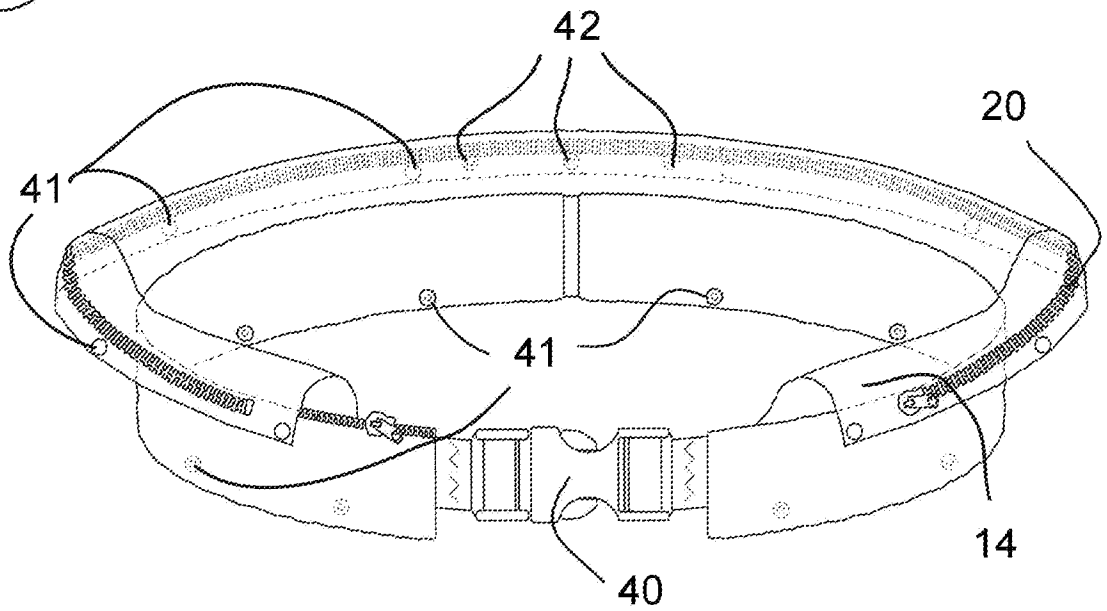
FIG. 3B Isometric view of the back of the belt showing the deployment and folding of the inner pocket that contains the Poncho.
Figure 4:
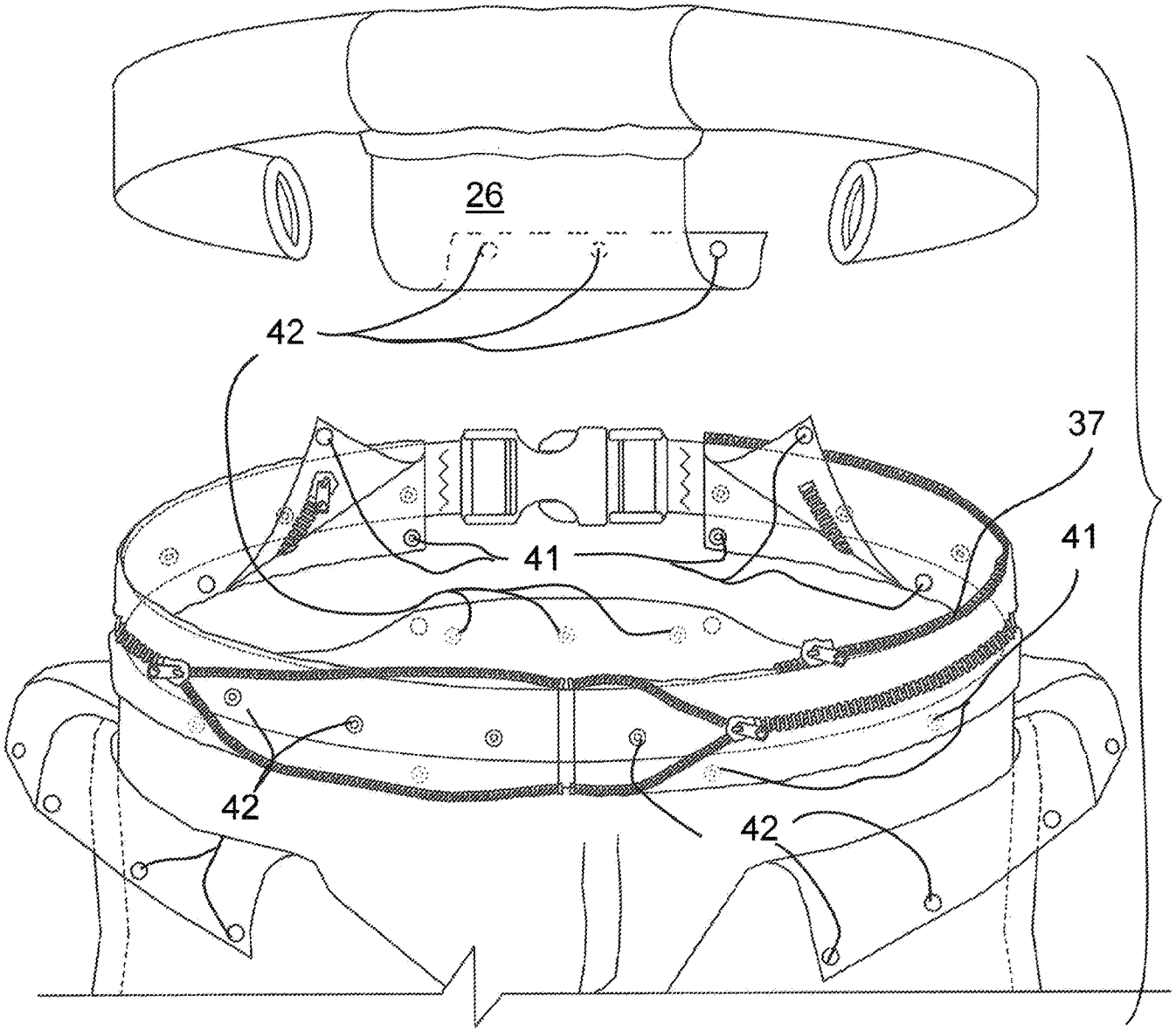
FIG. 4 Isometric view of all snap fasteners for the pants and the Poncho once rolled up FIG. 5A Isometric view of the storage phase of the poncho before being folded inside the belt.

Referring now to FIGS. 1A-B, and 3, there is provided a compact rain-suit 10 designed to be fitted inside a waist belt 12 that is buckled by way of a snap buckle 40.

The waist belt is made out of two sets of pockets: a poncho pocket 14, two pants pockets 15, 15'. There is also a tote bag 34 that also forms part of the belt 12. The poncho pocket 14 holds a rolled up poncho 18, and the leg pockets 15, 15' hold rolled up pant legs 16.

The poncho pocket is located on the interior perimeter of the belt 12 and is accessed by unsnapping the poncho pocket snaps 41 located on the legs pockets 15, 15', and rolling it upwardly so as to expose and access a poncho pocket zipper 20. Each leg of the pants 16 is located in its own leg pocket 15 and 15' and each leg pocket 15, 15' having its own pant zipper 21, 21' which are located on the outside periphery of the belt. There is also a pouch 34, with its own pouch zipper 23, which is used like a fanny pack. These pockets 14, 15, 15' co-exist within the thickness of the belt 12. As best seen in FIG. 3A, the poncho zipper 20 is hidden under a flap which is in fact the poncho pocket 14 and is held flat by way of male and female snap fasteners 41.

Back on FIGS. 1A-B, we can see, in overlapping views, the unrolling process for the pants 16 and how they are releasably snapped by snap fasteners 42 at the top of the pants 16 which are snapped inside the pockets 15, 15'. This allows for the pants 16 to be unsnapped from the belt 12, when one wants to wash them or if they need to be replaced if they get worn out over time. The pants 16 are akin to chaps in the sense that they come in two sections that are then zippered together by way of pant zipper 25. The same applies to the poncho 18 which has snaps 42 located inside the poncho pocket 14 and snapped to a flap 26.

Figure 5A:
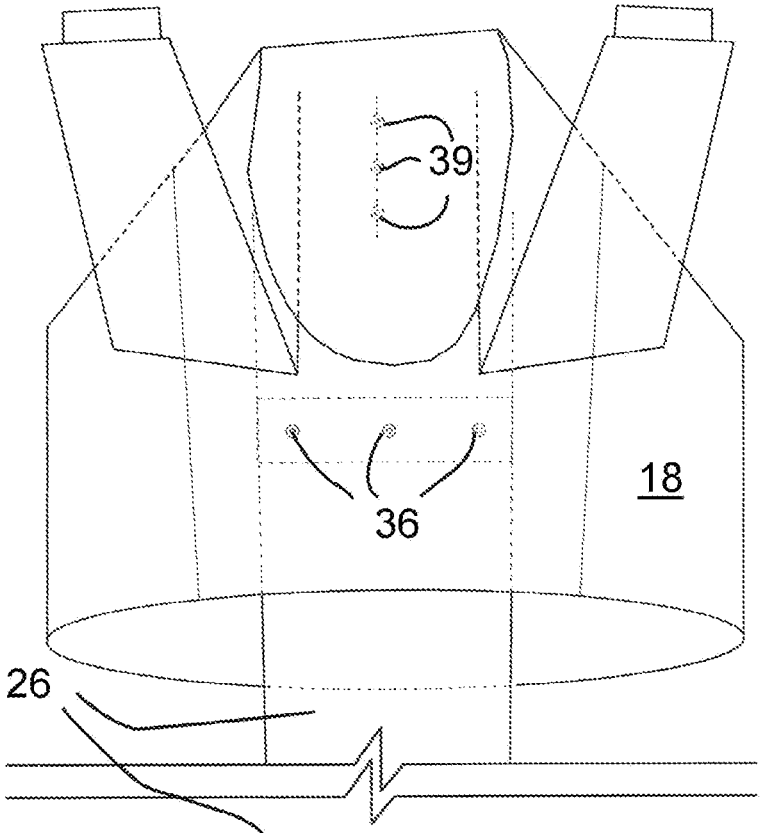
FIG. 5B Isometric view of the storage phase of the poncho folded inside the belt.
Figure 5B:
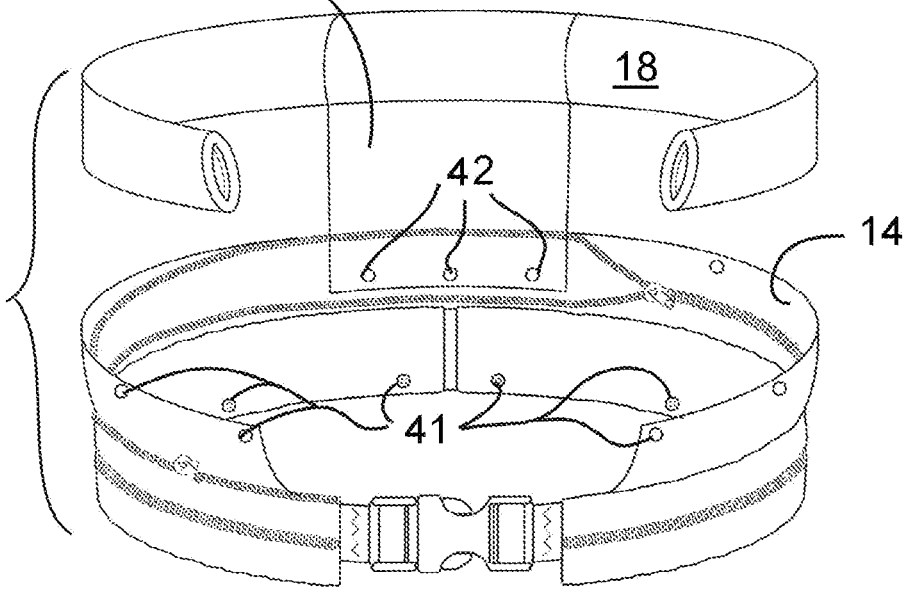

As best seen in FIGS. 5A-B The poncho 18 is also releasably attached to the belt 12 by way of the poncho flap 26 which is held to the belt 12 by way of the combination of male female snap fasteners 42. Because a regular poncho would not allow for a motorcycle helmet to pass through the neck opening, there is a neck opening 17 at the front of this poncho 18 with the neck opening 17 closed by way of buttons 39 which close the neck opening 17 portion of the poncho 18. Also, to facilitate the rolling of the poncho 18, it is wrapped with the help of the flap 26 which has a set of flap snaps 36.

As best seen in FIGS. 6A and 6C, the compact rain-suit 10 can be worn over the shoulder by adding a belt extension 28 which connects to the belt 12 using the snap buckle 44. It also has a pouch or tote bag 34 that is zippered onto the belt by way of a tote bag rim zipper 37 which runs proximal to the tote bag's own zipper 23 (can be confusing from the figures). The tote bag rim zipper 37 only has half of it on the belt 12, the other half being on the tote hag 34 itself. To attach the tote hag 34 to the belt 12, one connects the two halves of the tote hag rim zipper 23 as seen in FIG. 6C, and zip it up.

The chap style leg parts 16, and the poncho 18 are fully detachable by unsnapping from the snap fasteners 36, and 42 so that they can be replaced if damaged, or for washing in a washing machine, for example.

For visibility at night, reflective bands (38) provide a good signaling function. The reflective band (38) placed at the front of the belt (12) is often drawn in the raised position so as to see the junction of the zippers (21,21'). The reflective band (38) is better visible flat in FIG. 6A and FIG. 6B.

The waist belt 12 can be used in fanny pack mode (burn bag) or it can be worn over the shoulder when using the belt extension 28. One of the main advantage of having the belt extension 28 is that it can be worn shoulder mode with ease and comfort. For visibility at night, reflective bands 38 provide a good signaling function.

When it starts to rain, it takes a very short time to unroll the poncho 18 and the leg parts 16 without the need to take out one's boots since the leg parts 16 are opened like chaps to be then zippered all the until closed like pants. The advantage of such a system is not only that boots or shoes do not need to be removed but even if pant legs are wide enough for passing boots, there is a risk of damaging the pant's crutch and there is also the risk of losing balance and falling, which can cause body injury as well as damage the pants.

The compact rain-suit 10 has a method of use consisting in the steps of:

1) Unzipping the two leg compartments (15,15') and take them out while unrolling them (FIG. 1B);
2) One legging (16) at a time, join the two ends towards the inside of the upper thigh in order to zip the zipper (25) from the top downwards (FIG. 1B);
3) Unbutton the snap fasteners at the bottom (41) of the inside pocket (14) of the belt (12) in order to be able to lift it and have access to its zipper which faces the user;
4) Completely unzip the zipper (20) to remove the wrapped poncho (18);
5) Once out, unroll the poncho (18) towards the ground and put it on;
6) Unbutton the snap fasteners (36) on the collar to pass the motorcycle helmet on, if necessary;
7) To re-insert one or other of the parts of the rain suit, simply reverse the steps described above.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A compact rain-suit comprising a poncho;

a first pant leg and a second pant leg, a waist belt configured for encircling a user's waist, the waist belt comprising an interior perimeter, an outside periphery, a thickness, a snap buckle fastener, a poncho pocket, a first leg pocket, and a second leg pocket, the poncho pocket configured and sized to hold the poncho in a rolled configuration and, the first leg pocket configured and sized to hold the first pant leg in a rolled configuration and the second leg pocket configured and sized to hold the second pant leg in a rolled configuration, the poncho pocket attached to an upper edge of the waist belt along the interior perimeter, the poncho pocket comprising a zipper and snaps, the poncho snaps correspond to waist belt snaps attached to the interior of the waist belt, the poncho snaps are configured to allow one end of the poncho pocket to be released from the second snaps of the waist belt so that the pocket is rolled or flipped upwardly to expose and access the poncho zipper, the first leg pocket and the second leg pocket are separate from each other and are located on the outside periphery of the waist belt and extend within the thickness of the waist belt, the first leg pocket and the second leg pocket each comprise a zipper to allow access to the first pant leg and the second pant leg held therein; and wherein the poncho is deployable from the poncho pocket to be worn on an upper portion of the user's body and the first pant leg and the second panel leg are deployable from the first leg pocket and the second leg pocket to be worn on the user's leg as pants.

2. The compact rain-suit of claim 1 wherein: the first leg pocket and the second leg pocket each have an inside with attached pocket snaps, wherein the pocket snaps are configured to attached to pant leg snaps located on an upper part of each of the first pant leg and the second pant leg.

3. The compact rain-suit of claim 1 wherein: the first pant leg and the second pant leg each have two sections with zippers extending along the two sections, wherein the zippers of each of the two sections are configured to be zipped together to surround the user's leg.

4. The compact rain-suit of claim 1 wherein: the poncho being releasably attached inside the poncho pocket by a poncho flap, the poncho flap having snaps that releasably attach to snaps located inside the poncho pocket.

5. The compact rain-suit of claim 1 wherein: the poncho has a neck opening at a front, wherein the neck opening has buttons to adjust the size of the neck opening.

6. The compact rain-suit of claim 1 wherein: the poncho has an attached flap comprising a set of snaps that are configured to facilitate rolling of the poncho into the poncho pocket.

7. The compact rain-suit of claim 1 wherein: a belt extension is attached to the snap buckle fastener to lengthen the belt and allow the waist belt to be worn across the shoulder of the user.

8. The compact rain-suit of claim 1 wherein: the waist belt has a pouch releasably attached thereto by a zipper fastener.

9. The compact rain-suit of claim 8 wherein: the zipper fastener has a first zipper half attached to the rim of the pouch and a second zipper half attached to the waist belt.

10. The compact rain-suit of claim 8 wherein: the waist belt has reflective bands located thereon for improved visibility and signaling in the dark.

* * * * *